US009577369B2

(12) United States Patent
Suzuki

(10) Patent No.: US 9,577,369 B2
(45) Date of Patent: Feb. 21, 2017

(54) CONNECTOR

(71) Applicant: Sumitomo Wiring Systems, Ltd., Yokkaichi, Mie (JP)

(72) Inventor: Masakazu Suzuki, Mie (JP)

(73) Assignee: SUMITOMO WIRING SYSTEMS, LTD., Yokkaichi-Mie (JP)

( * ) Notice: Subject to any disclaimer, the term of this patent is extended or adjusted under 35 U.S.C. 154(b) by 0 days.

(21) Appl. No.: 14/906,035

(22) PCT Filed: Jun. 30, 2014

(86) PCT No.: PCT/JP2014/067361
§ 371 (c)(1),
(2) Date: Jan. 19, 2016

(87) PCT Pub. No.: WO2015/008609
PCT Pub. Date: Jan. 22, 2015

(65) Prior Publication Data

US 2016/0197432 A1 Jul. 7, 2016

(30) Foreign Application Priority Data

Jul. 17, 2013 (JP) ..... 2013-148561

(51) Int. Cl.
*H01R 13/40* (2006.01)
*H01R 13/52* (2006.01)
*H01R 13/506* (2006.01)

(52) U.S. Cl.
CPC ..... *H01R 13/521* (2013.01); *H01R 13/506* (2013.01); *H01R 13/5205* (2013.01); *H01R 13/5208* (2013.01)

(58) Field of Classification Search
CPC . H01R 13/521; H01R 13/5205; H01R 13/506; H01R 13/5208; H01R 13/52
(Continued)

(56) References Cited

U.S. PATENT DOCUMENTS 6,186,806 B1 2/2001 Suzuki et al.
7,104,841 B2 * 9/2006 Fukatsu et al. .... H01R 13/5208 439/275

FOREIGN PATENT DOCUMENTS

JP 2000-348837 12/2000
JP 2006-120561 5/2006
JP 2013-114844 6/2013

OTHER PUBLICATIONS

International Search Report. PCT/JP2014/067361 Dated Sep. 22, 2014.

* cited by examiner

*Primary Examiner* — Javaid Nasri
(74) *Attorney, Agent, or Firm* — Gerald E. Hespos; Michael J. Porco; Matthew T. Hespos

(57) ABSTRACT

A connector (F) includes a first terminal accommodating chamber (11), a rear end part of which defines a seal tower (12) projecting from a rear (10R) of a housing (10). A rubber plug (16) is fit on a first wire (15) and liquid-tightly contacts an inner surface of the first terminal accommodating chamber (11). Second wires (20) are drawn out from second terminal accommodating chambers (17). A one-piece rubber plug (30) covers the rear (10R) of the housing (10) and the second wires (20) and the seal tower (12) penetrate the one-piece rubber plug (30). Lock towers (21) project back from the rear (10R) of the housing (10) and penetrate the one-piece rubber plug (30). A rear holder (40) covers the one-piece rubber plug (30) from behind. Receiving portions (46) are formed in the rear holder (40) and lock to locking portions (23) of the lock towers (21).

5 Claims, 11 Drawing Sheets

CONNECTOR

BACKGROUND

1. Field of the Invention

The present invention relates to a connector.

2. Description of the Related Art

Japanese Unexamined Patent Publication No. 2013-114844 discloses a connector in which a plurality of terminal fittings are accommodated in a housing and wires connected to the respective terminal fittings are drawn out from the rear surface of the housing. This connector is provided with both individual sealing structures for sealing an individual rubber plug individually externally fitted on each wire by bringing the individual rubber plug into close contact with the inner peripheral surface of a terminal accommodating chamber and a collective sealing structure for sealing the wires by passing the wires into a plurality of seal holes formed in a one-piece rubber plug. Rear end parts of the terminal accommodating chambers for individual sealing project backward as seal tower portions from the rear surface of the housing and these seal tower portions penetrate through holes formed in the one-piece rubber plug. In this way, individual sealing areas and a collective sealing area out of the rear surface of the housing are covered by one one-piece rubber plug.

In this connector, a peripheral wall portion is caused to project from the rear surface of the housing as a means for holding the one-piece rubber plug in a state mounted in the housing and the one-piece rubber plug is accommodated in an accommodation space in the peripheral wall portion. Further, a rear holder is provided to cover the rear surface of the one-piece rubber plug and assembled in a state accommodated in the accommodation space. Furthermore, the connector of patent literature 1 is configured to be fitted into a receptacle of a male mating connector and a ring-shaped sealing means is necessary on the outer periphery of the housing as a sealing means for sealing a connected part to the mating connector.

The peripheral wall portion in the connector of Japanese Unexamined Patent Publication No. 2013-114844 is an essential structure since having a function of accommodating the one-piece rubber plug and a function of supporting the rear holder. Since the peripheral wall portion surrounds the one-piece rubber plug, it is not structurally possible to cause an outer peripheral part of the one-piece rubber plug to function as the sealing means to the mating connector. As just described, since the connector of patent literature 1 requires the sealing means to the mating connector to be provided separately from the one-piece rubber plug, there is a problem of increasing the number of components.

The present invention was completed based on the above situation and aims to reduce the number of components.

SUMMARY

The present invention is directed to a connector with a housing. A first terminal accommodating chamber is formed in the housing, and a rear end part thereof defines a tubular seal tower projecting back from a rear surface of the housing. A first terminal fitting is inserted in the first terminal accommodating chamber. A first wire is connected to the first terminal fitting and drawn out backward from the housing. An individual rubber plug is fit externally on the first wire and is held liquid-tightly in close contact with an inner peripheral surface of the first terminal accommodating chamber. Second terminal accommodating chambers are formed in the housing, and second terminal fittings are inserted respectively in the second terminal accommodating chambers. Second wires are connected to the second terminal fittings and are drawn out to outside from the rear surface of the housing. A one-piece rubber plug is mounted in the housing to cover an entire area of the rear surface of the housing. Seal holes are formed in the one-piece rubber plug, and the of second wires liquid-tightly penetrate through the seal holes. A through hole is formed in the one-piece rubber plug, and the seal tower penetrates through the through hole. A lock tower projects back from the rear surface of the housing. The lock tower penetrates through the one-piece rubber plug and is formed with a locking portion on a projecting end part. A rear holder is arranged to cover the one-piece rubber plug from behind. A receiving portion is formed in the rear holder and is configured to lock the rear holder in a state assembled with the housing by being locked to the locking portion. A seal is formed on an outer periphery of the one-piece rubber plug and is capable of being liquid-tightly held in close contact with an inner periphery of a mating connector. The rear holder is cantilevered forward and includes a peripheral wall surrounding an outer peripheral surface of the housing and an outer peripheral surface of the one-peace rubber plug.

According to this configuration, the rear holder and the housing are locked in an assembled state by a locking action of the locking portion of the lock tower penetrating through the one-piece rubber plug and the receiving portion of the rear holder. Since the one-piece rubber plug can be held in a state mounted in the housing without surrounding the outer periphery of the one-piece rubber plug in this way, it can be realized to provide the seal portion as a means for sealing a connected part to the mating connector on the outer periphery of the one-piece rubber plug. Thus, the number of components can be reduced according to the present invention. Further, these seal portion of the one-peace rubber plug can be protected from the interference of external matters and the like by the peripheral wall.

The one-piece rubber plug may include a communication hole and the lock tower may liquid-tightly penetrate through the communication hole. According to this configuration, the lock tower exhibits a function of positioning the one-piece rubber plug. Thus, the shape of the housing can be simplified as compared to the case where a dedicated positioning means separate from the lock tower is provided. The communication hole potentially could become a water entrance path extending from the back of the one-piece rubber plug to the rear surface of the housing. However, the lock tower liquid-tightly penetrates through the communication hole so that there is no possibility of water entrance through the communication hole.

The receiving portion may interfere with a tip part of the locking portion and may resiliently deflect to retract in the process of assembling the rear holder with the housing. According to this configuration, the lock tower portion including the locking portion needs to be hardly deformed in the process of assembling the rear holder with the housing, wherefore a liquid-tight state between the lock tower portion and the communication hole is reliably maintained.

The connector may include a positioning hole formed in the rear holder, and the seal tower portion being fitted into the positioning hole. According to this configuration, the rear holder is positioned with respect to the housing when the seal tower is fit into the positioning hole of the rear holder. Since the seal tower additionally has a function of positioning the rear holder, the shape of the housing can be simplified as compared to the case where a dedicated positioning means separate from the seal tower is provided.

DETAILED DESCRIPTION

Figure 1:
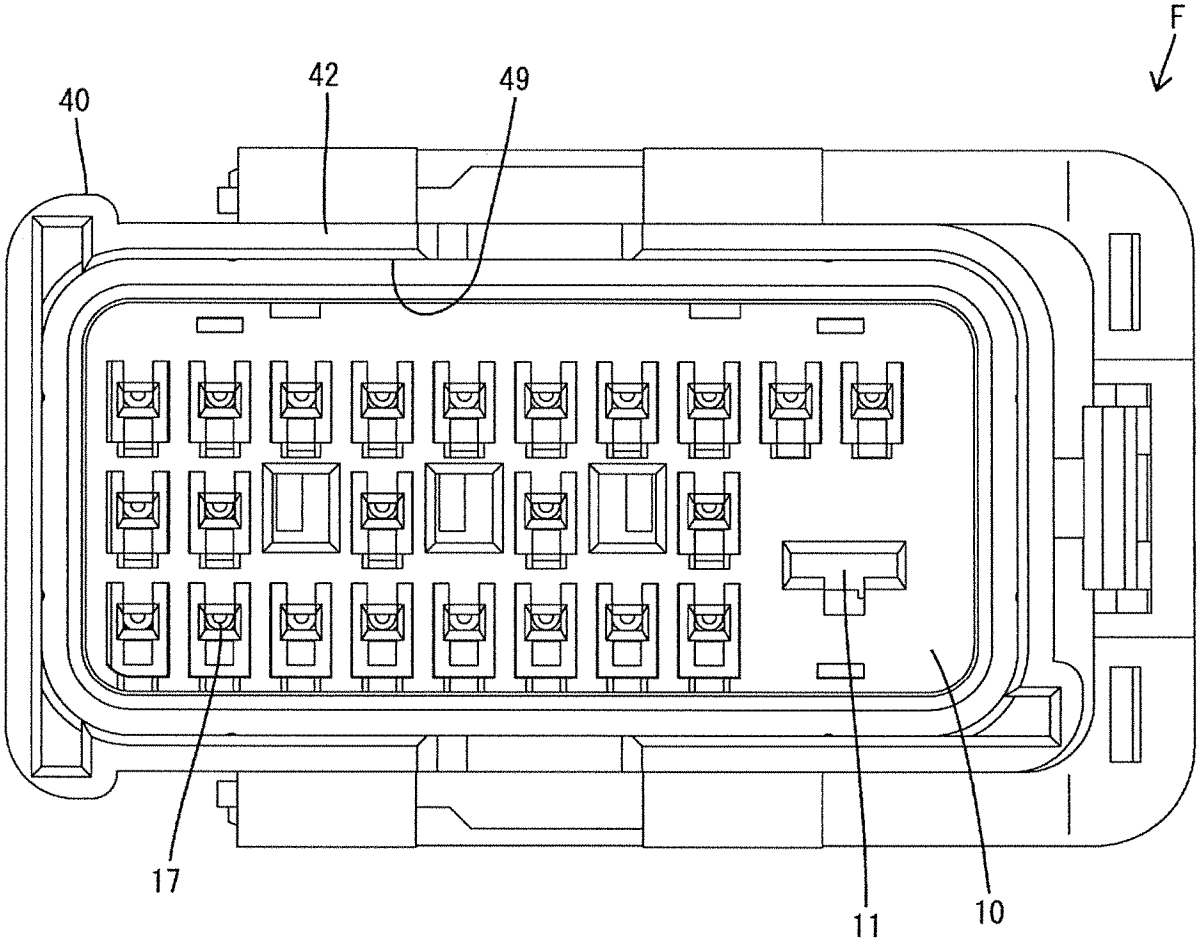
FIG. 1 is a front view of a connector of one embodiment.

Hereinafter, one specific embodiment of the present invention is described with reference to FIGS. 1 to 11. A female connector F (connector as defined in claims) of this embodiment includes a housing 10 formed with one first terminal accommodating chamber 11 and twenty three second terminal accommodating chambers 17 inside, a first terminal fitting 13, a first wire 15, an individual rubber plug 16, second terminal fittings 18, second wires 20, a one-piece rubber plug 30 and a rear holder 40.

Figure 3:
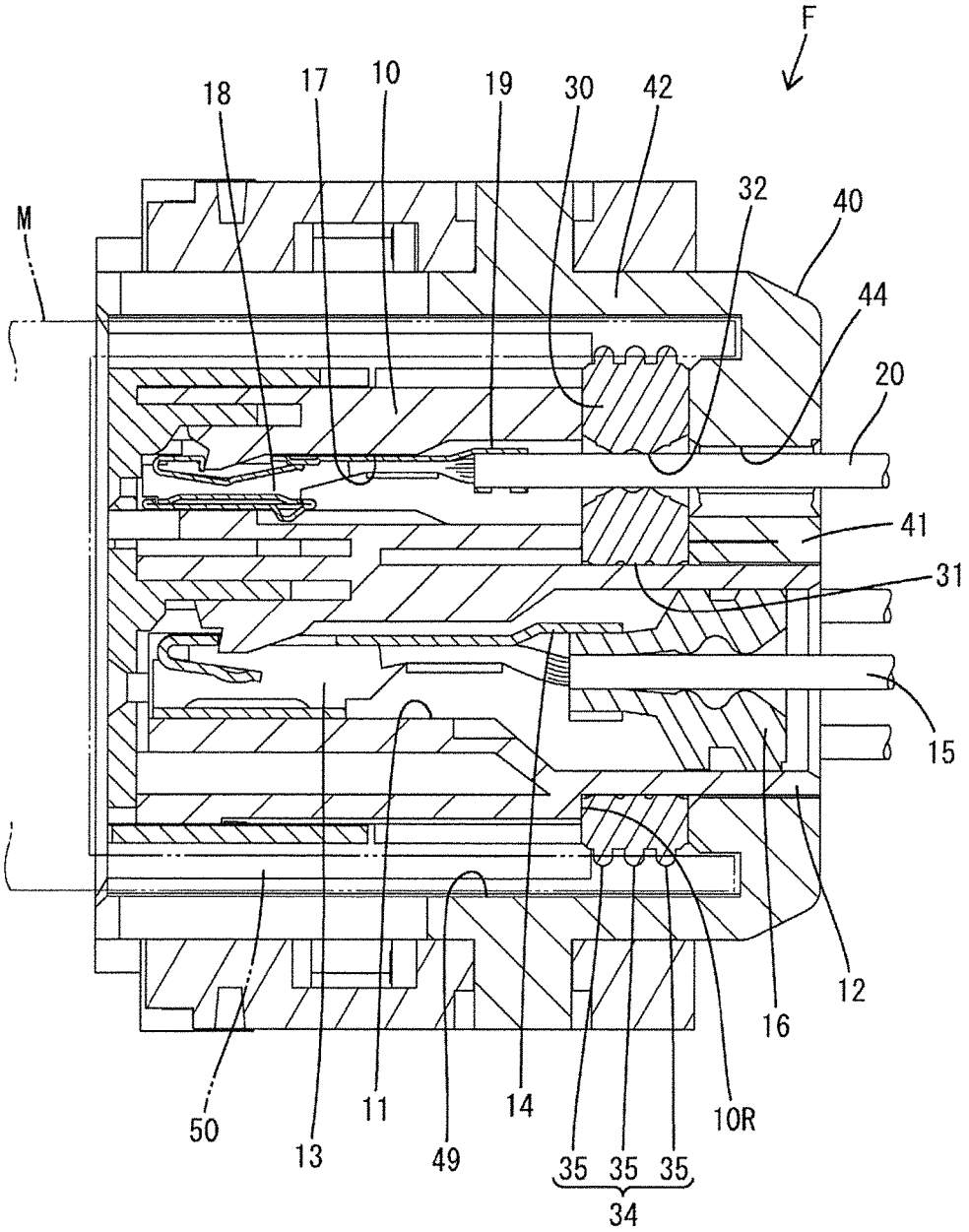
FIG. 3 is a section along X-X of FIG. 2.
Figure 5:
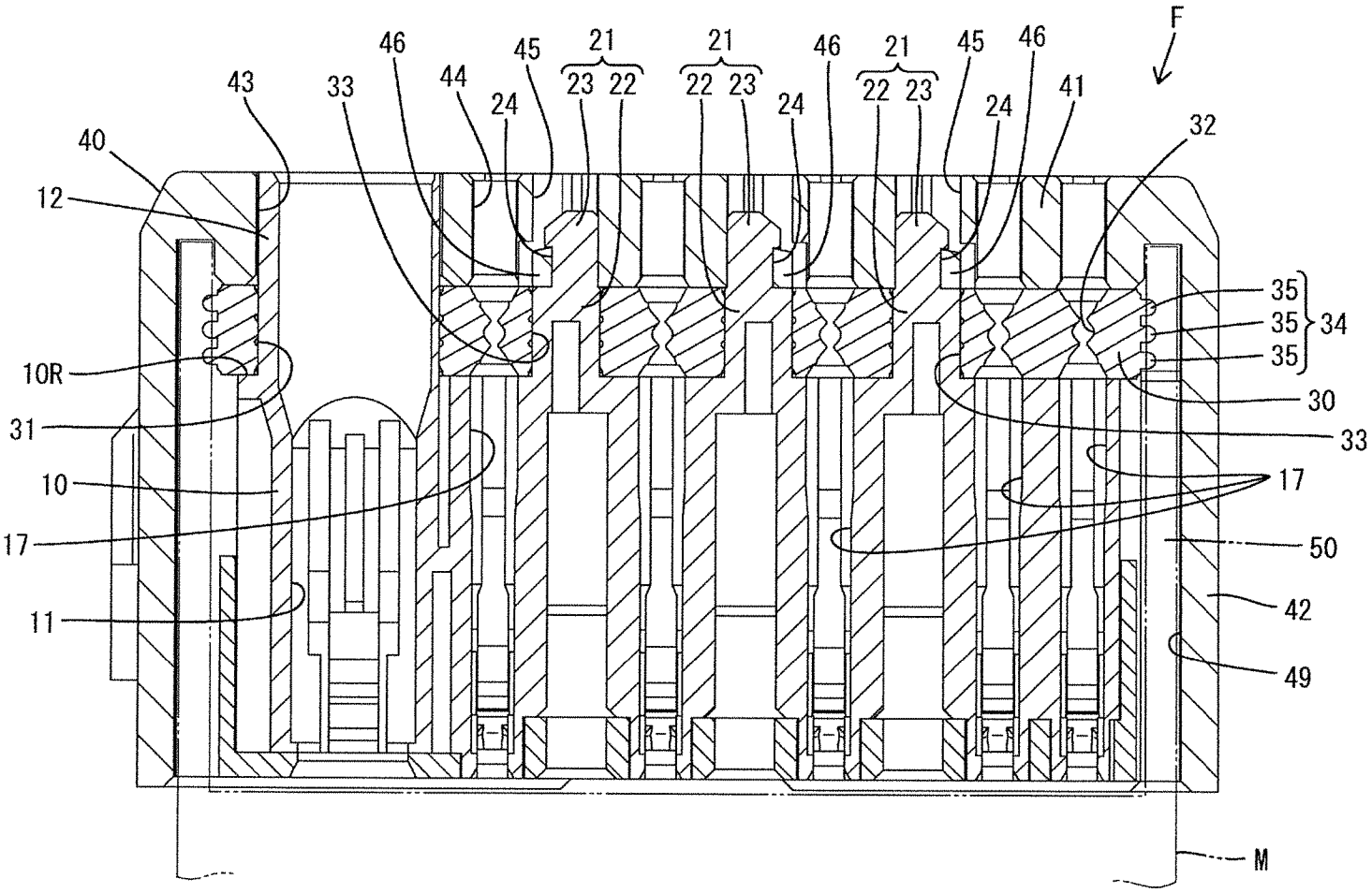
FIG. 5 is a section along Z-Z of FIG. 2.
Figure 6:
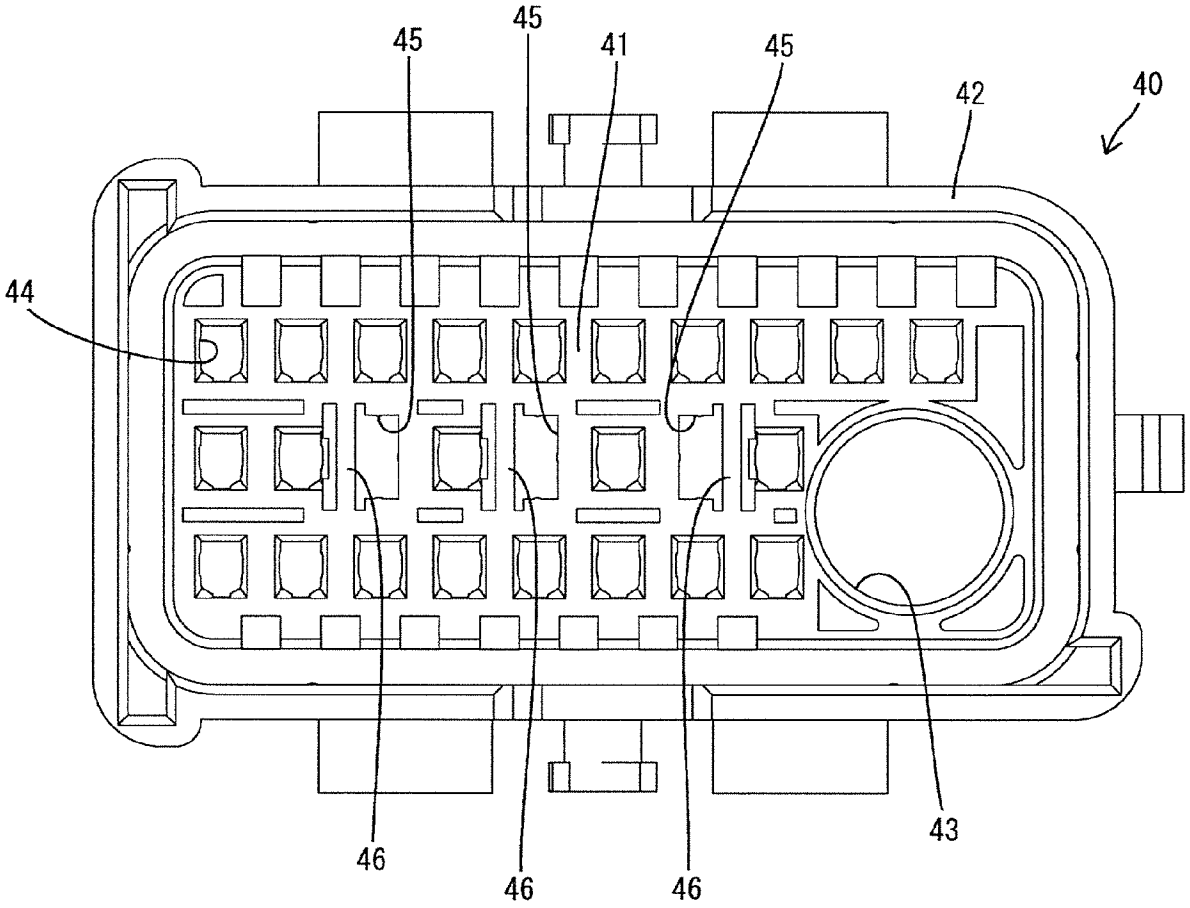
FIG. 6 is a front view of a rear holder.
Figure 7:
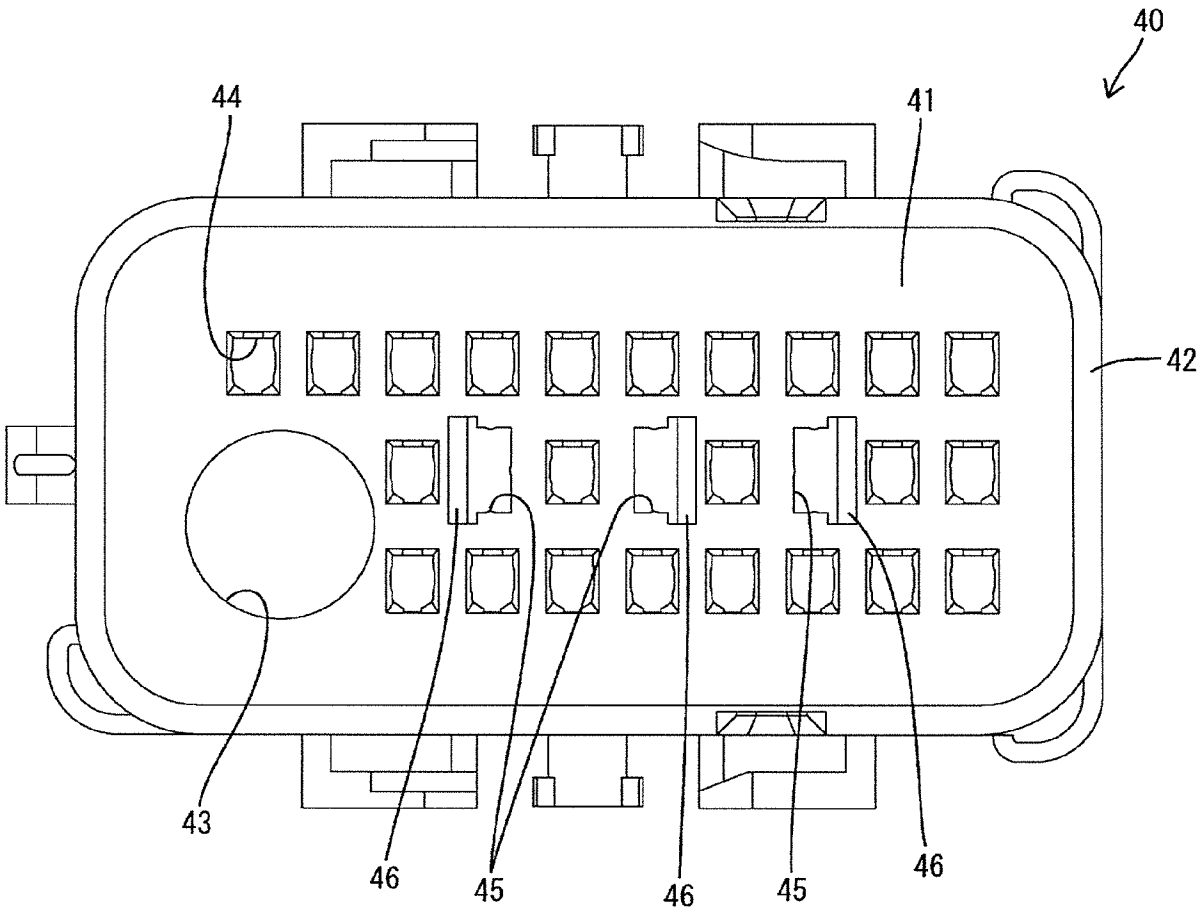
FIG. 7 is a rear view of the rear holder.
Figure 8:
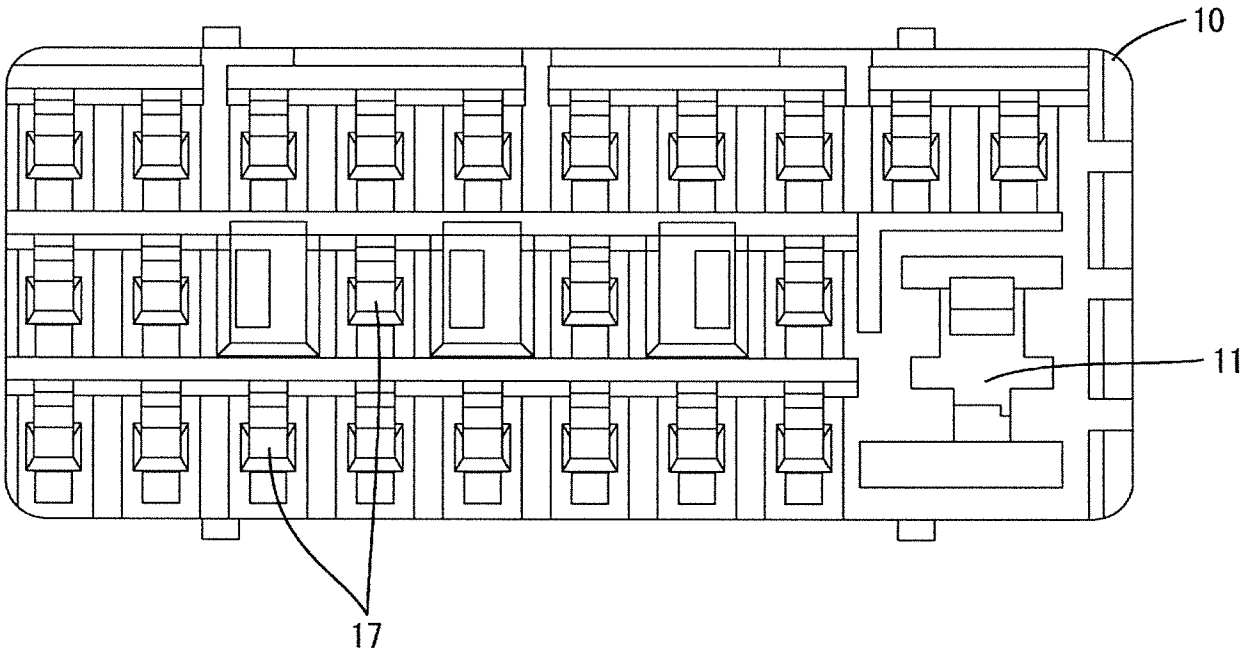
FIG. 8 is front view of a housing.
Figure 9:
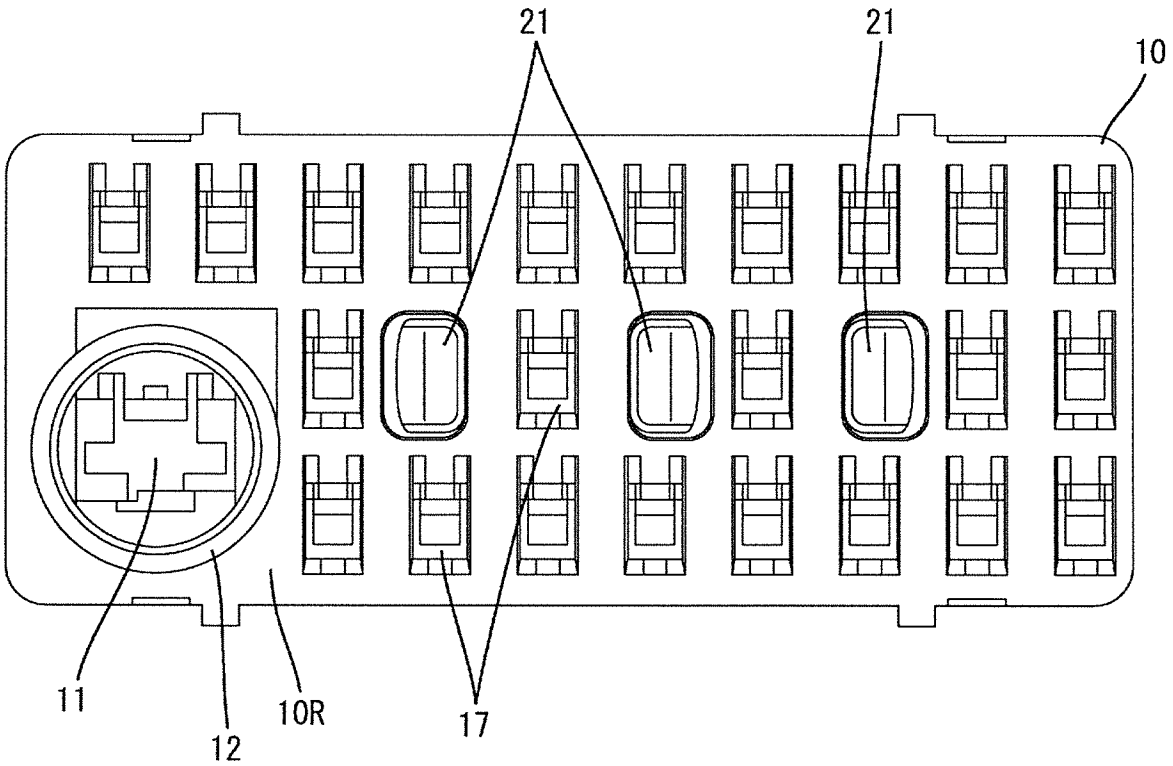
FIG. 9 is a rear view of the housing.
Figure 10:
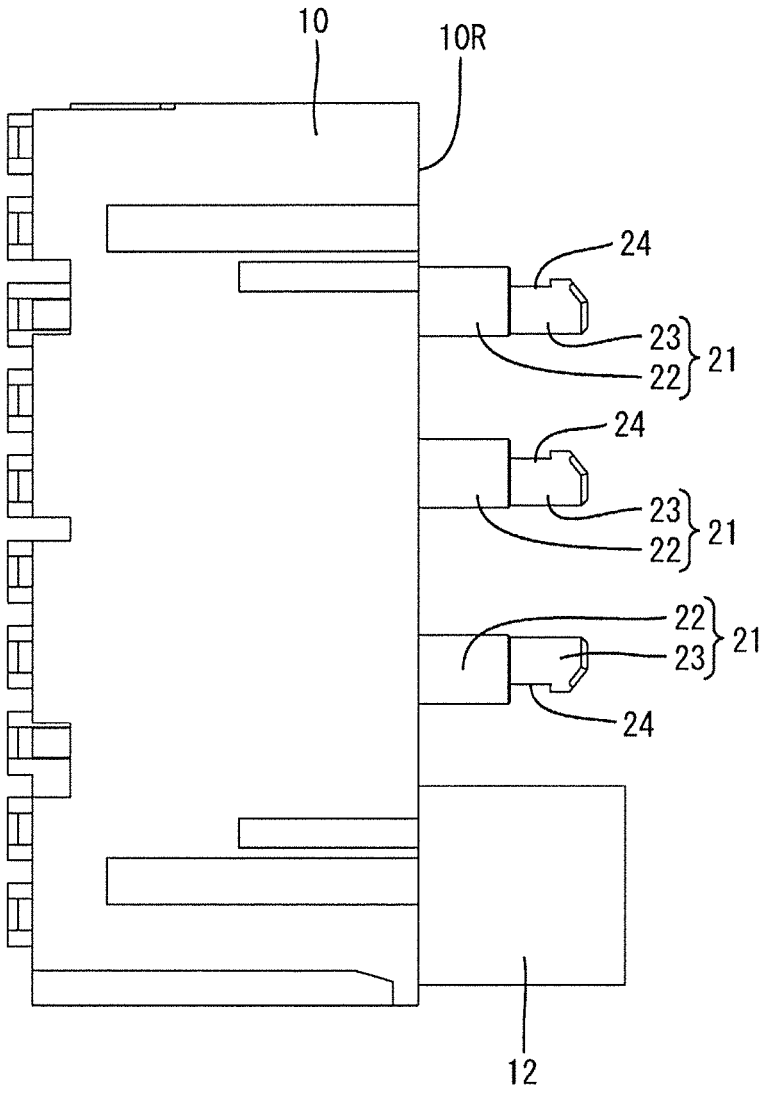
FIG. 10 is a plan view of the housing.

As shown in FIG. 9, the first terminal accommodating chamber 11 is arranged to be open on a left end part of a rear surface 10R of the housing 10. As shown in FIGS. 3 and 5, a rear end part of the first terminal accommodating chamber 11 serves as a hollow cylindrical seal tower 12 projecting back from the rear surface 10R of the housing 10. As shown in FIG. 3, the first terminal fitting 13 is inserted into the first terminal accommodating chamber 11 from behind the housing 10. A first crimping portion 14 on the rear end of the first terminal fitting 13 is crimped and connected to a front end part of the first wire 15. A hollow cylindrical individual rubber plug 16 is fixed to the first crimping portion 14 while being externally fitted on the first wire 15.

With the first terminal fitting 13 properly inserted in the first terminal accommodating chamber 11, the inner periphery of the individual rubber plug 16 is held liquid-tightly in close contact with the outer periphery of the first wire 15 and the outer periphery of the individual rubber plug 16 is held liquid-tightly in close contact with the inner peripheral surface of the seal tower 12 (first terminal accommodating chamber 11). This individual rubber plug 16 constitutes an individual sealing structure and regulates the entrance of liquid into the first terminal accommodating chamber 11 from behind the housing 10.

Figure 2:
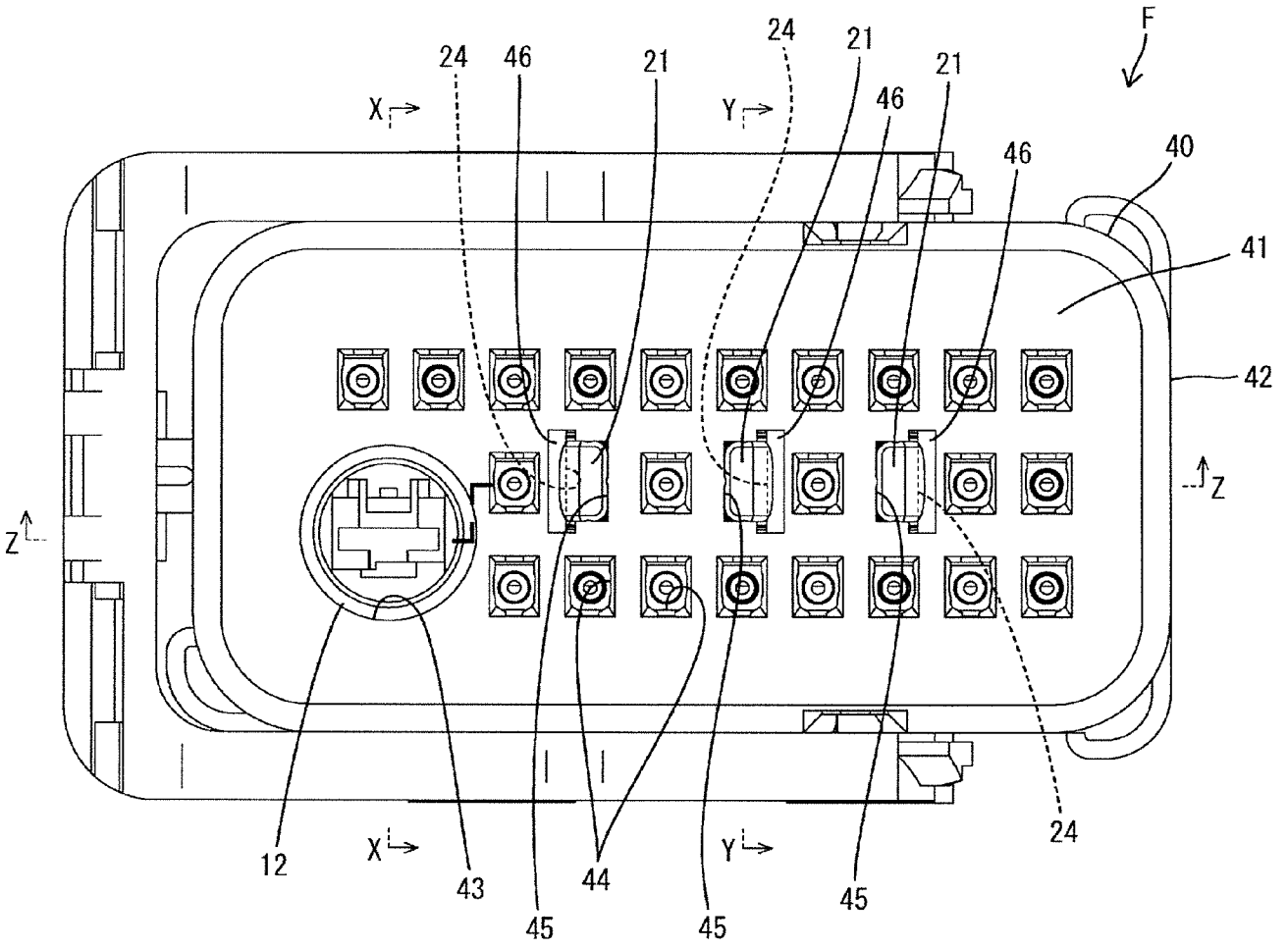
FIG. 2 is a rear view of the connector.

As shown in FIGS. 3 and 5, the rear end of the second terminal accommodating chamber 17 is open on the rear surface 10R of the housing 10. Thus, the rear end of the first terminal accommodating chamber 11 (seal tower 12) is open at a position behind the rear end of the second terminal accommodating chamber 17. An opening area of the second terminal accommodating chamber 17 on the rear surface 10R of the housing 10 is smaller than that of the first terminal accommodating chamber 11. As shown in FIGS. 2 and 9, twenty three second terminal accommodating chambers 17 are arranged in three stages separated in a vertical direction.

Ten second terminal accommodating chambers 17 in the upper stage are arranged to be higher than the first terminal accommodating chamber 11. The second terminal accommodating chamber 17 on the left end and the second one from the left end are located right above the first terminal accommodating chamber 11. Five second terminal accommodating chambers 17 in the middle stage and eight terminal accommodating chambers 17 in the lower stage are arranged at heights overlapping with the first terminal accommodating chamber 11 in the vertical direction. All the second terminal accommodating chambers 17 in the middle stage and all the second terminal accommodating chambers 17 in the lower stage are located to the right of the first terminal accommodating chamber 11.

Figure 4:
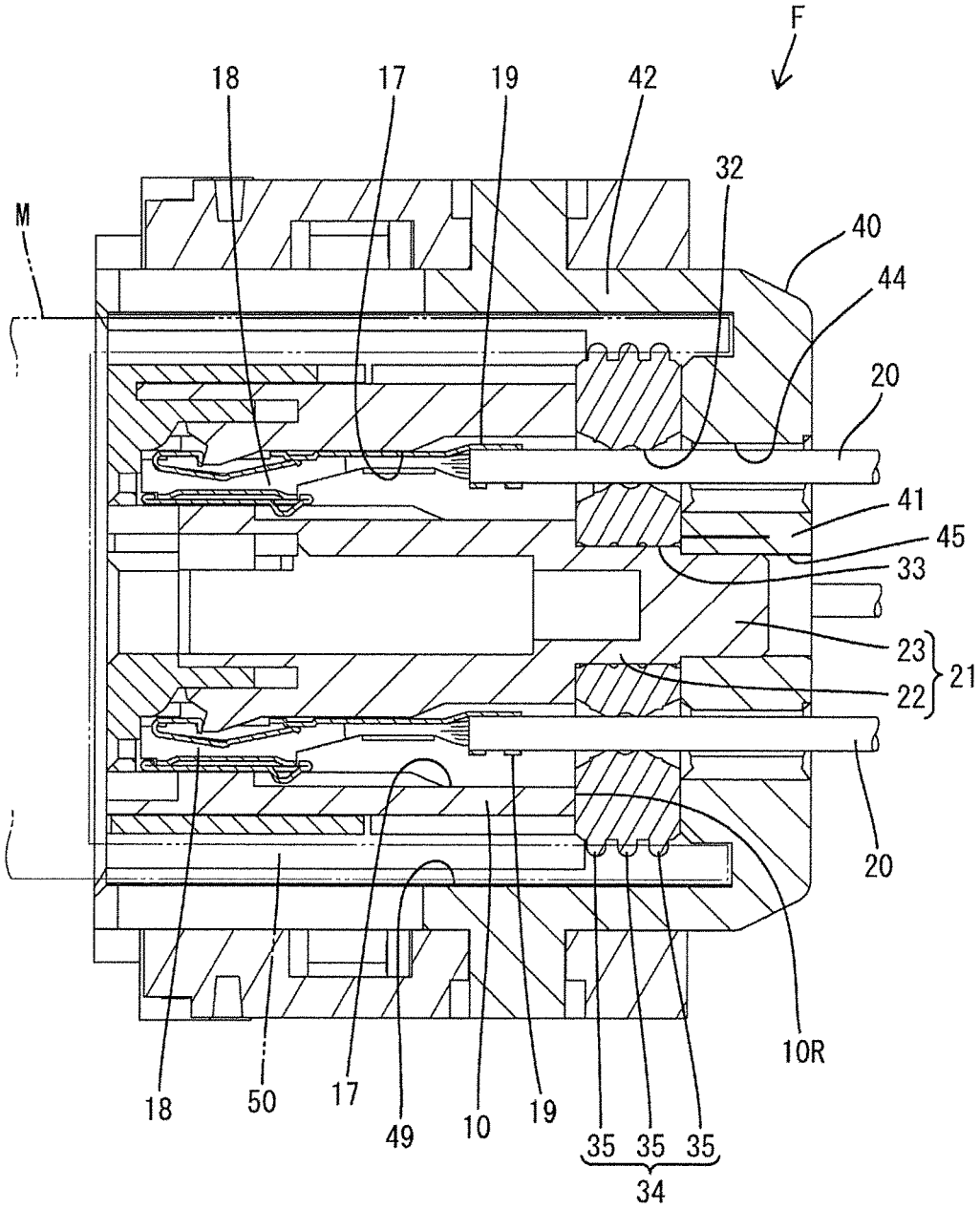
FIG. 4 is a section along Y-Y of FIG. 2.

As shown in FIGS. 3 and 4, the second terminal fitting 18 is inserted into each second terminal accommodating chamber 17 from behind the housing 10. A second crimping portion 19 on the rear end of each second terminal fitting 18 is crimped and connected to a front end part of the second wire 20. Twenty three second terminal fittings 18 to be inserted into the second terminal accommodating chambers 17 are components identical in dimensions and shape. The second terminal fittings 18 are smaller in dimensions than the first terminal fitting 13.

The housing 10 is formed with three lock towers 21 cantilevered back from the rear surface 10R. As shown in FIGS. 2 and 9, the three lock towers 21 are formed at positions at the same height as the second terminal accommodating chambers 17 in the middle stage. One second terminal accommodating chamber 17 is located between the right lock tower 21 and the center lock tower 21, one second terminal accommodating chamber 17 is located also between the center lock tower 21 and the left lock tower 21 and one second terminal accommodating chamber 17 is located also between the left lock tower 21 and the first terminal accommodating chamber 11.

Each lock tower 21 has a non-circular, i.e. substantially rectangular cross-sectional shape. A front end area of each lock tower 21 connected to the rear surface 10R of the housing 10 serves as a base 22. A rear end area of each lock tower 21 serves as a locking portion 23. The locking portion 23 of the right lock tower 21 and that of the center lock tower 21 are formed with a locking recess 24 by recessing the right side surfaces thereof. The locking portion 23 of the left lock tower 21 is formed with a locking recess 24 by recessing the left side surface thereof.

As shown in FIGS. 3 to 5, the one-piece rubber plug 30 is mounted in a rear end part of the housing 10. The one-piece rubber plug 30 is arranged to cover the entire area of the rear surface 10R of the housing 10. Thus, an area of the rear surface 10R of the housing 10 corresponding to the one-piece rubber plug 30 is a substantially rectangular area including all openings of the one first terminal accommodating chamber 11 and the twenty three second terminal accommodating chambers 17.

Figure 11:
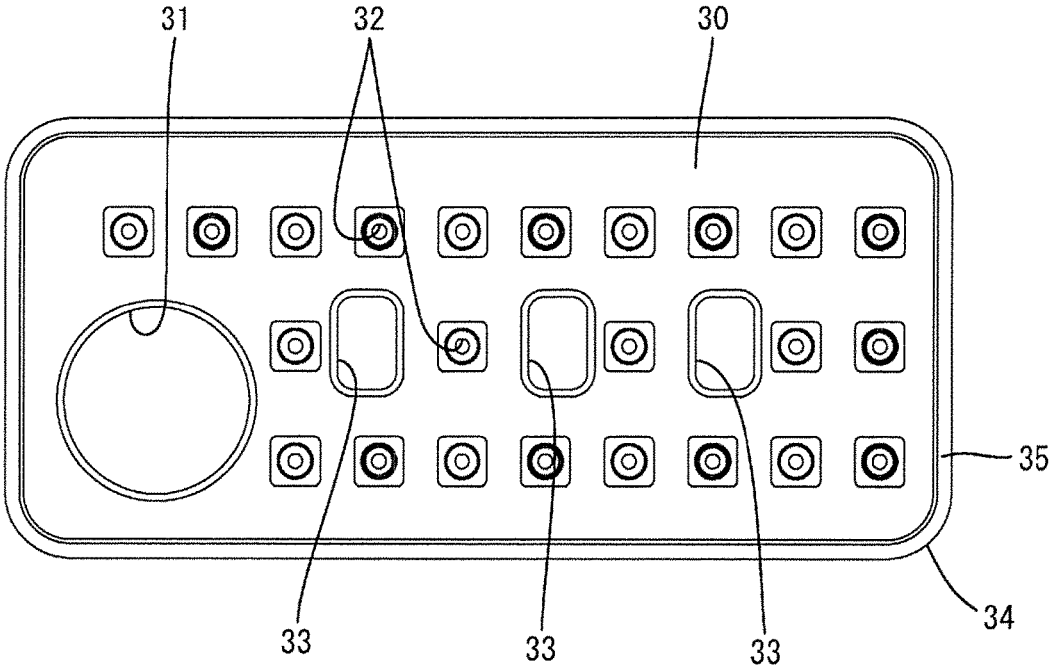
FIG. 11 is a rear view of a one-piece rubber plug.

As shown in FIG. 11, the one-piece rubber plug 30 is formed with a circular through hole 31 corresponding to the seal tower 12. As shown in FIG. 3, a front end area of the seal tower 12 penetrates through the through hole 31. The inner periphery of the through hole 31 and the outer periphery of the seal tower 12 are held liquid-tightly in close contact. In this way, the entrance of liquid into the housing 10 through a clearance between the through hole 31 and the seal tower 12 is regulated. Further, by fitting the seal tower 12 and the through hole 31, displacements of the one-piece rubber plug 30 in both vertical and lateral directions (both are directions intersecting with a penetrating direction of the seal tower portion 12 through the through hole 31) are suppressed.

Further, as shown in FIG. 11, the one-piece rubber plug 30 is formed with twenty three circular seal holes 32 corresponding to all the second terminal accommodating chambers 17 and penetrating in a front-back direction. As shown in FIGS. 3 and 4, each second wire 20 drawn out backward from the second terminal accommodating chamber 17 penetrates through the seal hole 32 and is drawn out backward from the one-piece rubber plug 30. Thus, the inner periphery of the seal hole 32 and the outer periphery of the second wire 20 are held liquid-tightly in close contact. In this way, the entrance of liquid into the housing 10 through a clearance between the seal hole 32 and the second wire 20 is regulated.

Further, as shown in FIG. 11, the one-piece rubber plug 30 is formed with three communication holes 33 corresponding to the three lock towers 21 and penetrating in the front-back direction. An opening shape of the communication holes 33 is non-circular similarly to the lock towers 21. The base portion 22 of the lock tower 21 penetrates through the respective communication hole 33. The outer periphery of the base portion 22 and the inner periphery of the communication hole 33 are held liquid-tightly in close contact. In this way, the entrance of liquid into the housing 10 through a clearance between the communication hole 33 and the base 22 is regulated.

A seal 34 extending in a circumferential direction is formed continuously over the entire circumference on the outer periphery of the one-piece rubber plug 30. The seal 34 is composed of a plurality of (three in this embodiment) rib-like lips 35 projecting from the outer peripheral surface of the one-piece rubber plug 30. The lips 35 are continuous over the entire circumference of the one-piece rubber plug 30. Note that the number of the lips 35 constituting the seal 34 may be two or less or four or more.

The rear holder 40 is made of synthetic resin and configured by integrally forming a rear wall 41 and a peripheral wall 42 cantilevered forward from the outer peripheral edge of the rear wall 41. The rear holder 40 is assembled with the housing 10 by being brought closer from behind. In an assembled state, the front surface of the rear wall 41 is in contact with or proximately facing the rear surface of the one-piece rubber plug 30 and the one-piece rubber plug 30 is sandwiched between the rear surface 10R of the housing 10 and the rear wall 41 in the front-back direction.

In this way, the one-piece rubber plug 30 is held in a state mounted in the housing 10. Further, the peripheral wall 42 surrounds the outer peripheral surface of the housing 10 and the outer peripheral surface of the one-piece rubber plug 30 in a non-contact manner. As shown in FIGS. 3 to 5, a space between the inner peripheral surface of the peripheral wall 42 and the outer peripheral surfaces of the housing 10 and the one-piece rubber plug 30 serves as a forwardly open connection space 49. A receptacle 50 of a male mating connector M is fit into the connection space 49.

The rear wall 41 is formed with a circular positioning hole 43 corresponding to the seal tower 12 and penetrating in the front-back direction. A rear end part of the seal tower 12 is fit into the positioning hole 43. In this way, the rear holder 40 is positioned with respect to the housing 10 in the vertical and lateral directions (i.e. directions intersecting with an assembling direction of the rear holder 40 with the housing 10). Similarly, the rear wall 41 is formed with twenty three insertion holes 44 positioned to individually correspond to the respective seal holes 32 and penetrating in the front-back direction. The second terminal fitting 18 and the second wire 20 are inserted into the insertion hole 44 from behind.

Further, the rear wall 41 is formed with three escaping recesses 45 corresponding to the communication holes 33 and penetrating in the front-back direction. Each escaping recess 45 is formed with a resiliently deflectable receiving portion 46 bridging between inner wall surfaces thereof in the vertical direction. The receiving portion 46 is resiliently deflectable in the lateral direction. The locking portion 23 of the corresponding lock tower portion 21 is accommodated in each escaping recess 45 and the locking portion 23 is fit in the locking recess 24.

In the process of assembling the rear holder 40 with the housing 10, the receiving portions 46 interfere with tip parts of the locking portions 23 and are resiliently deflected to retract in the lateral direction. When the rear holder 40 is properly assembled with the housing 10, the receiving portions 46 having resiliently returned are locked to the locking recesses 24 with relative displacements in the front-back direction regulated. By this locking action, the housing 10 and the rear holder 40 are locked with the separation thereof in the front-back direction regulated.

The female connector F of this embodiment includes the lock towers 21 projecting backward from the rear surface 10R of the housing 10, penetrating through the one-piece rubber plug 30 and formed with the locking portion 23 on a projecting end part, the rear holder 40 arranged to cover the one-piece rubber plug 30 from behind, the receiving portions 46 formed in the rear holder 40 and configured to lock the rear holder 40 in the state assembled with the housing 10 by being locked to the locking portions 23 and the seal 34 formed on the outer periphery of the one-piece rubber plug 30 and capable of being liquid-tightly held in close contact with the inner periphery of the receptacle 50 of the mating connector M.

According to this female connector F, the rear holder 40 and the housing 10 are locked in the assembled state by the locking action of the locking portions 23 of the lock towers 21 penetrating through the one-piece rubber plug 30 and the receiving portions 46 of the rear holder 40. Since the one-piece rubber plug 30 can be held in the state mounted in the housing 10 without surrounding the outer periphery of the one-piece rubber plug 30 in this way, it can be realized to provide the seal 34 as a means for sealing a part connected to the mating connector M on the outer periphery of the one-piece rubber plug 30. Thus, the number of components can be reduced according to the female connector F of this embodiment.

Further, in the female connector F of this embodiment, the one-piece rubber plug 30 is formed with the communication holes 33 through which the lock towers 21 liquid-tightly penetrate. This causes the lock towers 21 to exhibit a function of positioning the one-piece rubber plug 30. Thus, the shape of the housing 10 can be simplified as compared to the case where a dedicated positioning means separate from the lock towers 21 is provided. Further, since the lock towers 21 penetrate through the communication holes 33, the communication holes 33 may serve as water entrance paths extending from the back of the one-piece rubber plug 30 to the rear surface of the housing 10. However, since the seal towers 21 liquid-tightly penetrate through the communication holes 33, there is no possibility of water entrance through the communication holes 33.

Further, in the process of assembling the rear holder 40 with the housing 10, the receiving portions 46 interfere with the tip parts of the locking portions 23 and are resiliently deflected to retract. According to this configuration, the lock towers 21 including the locking portions 23 need to be hardly deformed in the process of assembling the rear holder 40 with the housing 10, wherefore a liquid-tight state between the lock towers 21 and the communication holes 33 is maintained reliably.

Further, in the female connector F of this embodiment, the rear holder 40 is formed with the positioning hole 43 into which the seal tower 12 is to be fit. According to this configuration, when the seal tower 12 is fit into the positioning hole 43 of the rear holder 40, the rear holder 40 is positioned with respect to the housing 10. Since the seal tower 12 additionally has a function of positioning the rear holder 40, the shape of the housing 10 can be simplified as compared to the case where a dedicated positioning means is provided separately from the seal tower 12.

Further, the rear holder 40 is formed with the peripheral wall 42 surrounding the outer peripheral surface (surface on which the lips 35 are formed) of the one-piece rubber plug 30. According to this configuration, the seal 34 (lips 35) of the one-piece rubber plug 30 can be protected from the interference of external matter and the like by the peripheral wall 42.

The present invention is not limited to the above described and illustrated embodiment. For example, the following embodiments also are included in the technical scope of the present invention.

Although one first terminal accommodating chamber is provided in the above embodiment, two or more first terminal accommodating chambers may be provided.

Although twenty three second terminal accommodating chambers are provided in the above embodiment, twenty two or less or twenty four or more second terminal accommodating chambers may be provided.

Although the first terminal accommodating chamber and the plurality of second terminal accommodating chambers are asymmetrically arranged in the above embodiment, the first terminal accommodating chamber and the plurality of second terminal accommodating chambers may be symmetrically arranged with respect to a virtual axis line parallel to an alignment direction of the second terminal accommodating chambers (vertical or lateral direction).

Although the seal tower additionally has the function of positioning the rear holder in the above embodiment, a dedicated positioning means for positioning the rear holder may be provided separately from the seal tower.

LIST OF REFERENCE SIGNS

F . . . female connector (connector)
M . . . mating connector
10 . . . housing
10R . . . rear surface of housing
11 . . . first terminal accommodating chamber
12 . . . seal tower portion
13 . . . first terminal fitting
15 . . . first wire
16 . . . individual rubber plug
17 . . . second terminal accommodating chamber
18 . . . second terminal fitting
20 . . . second wire
21 . . . lock tower portion
23 . . . locking portion
30 . . . one-piece rubber plug
31 . . . through hole
32 . . . seal hole
33 . . . communication hole
34 . . . seal portion
40 . . . rear holder
43 . . . positioning hole

The invention claimed is:

1. A connector, comprising:

a housing;

a first terminal accommodating chamber formed in the housing, a rear end part thereof serving as a tubular seal tower projecting backward from a rear surface of the housing;

a first terminal fitting inserted in the first terminal accommodating chamber;

a first wire connected to the first terminal fitting and drawn out backward from the housing;

an individual rubber plug externally fitted on the first wire and to be liquid-tightly held in close contact with an inner peripheral surface of the first terminal accommodating chamber;

a plurality of second terminal accommodating chambers formed in the housing;

a plurality of second terminal fittings inserted in the plurality of second terminal accommodating chambers;

a plurality of second wires connected to the plurality of second terminal fittings and drawn out to outside from the rear surface of the housing;

a one-piece rubber plug mounted in the housing to cover an entire area of the rear surface of the housing;

a plurality of seal holes formed in the one-piece rubber plug, the plurality of second wires liquid-tightly penetrating through the seal holes;

a through hole formed in the one-piece rubber plug, the seal tower penetrating through the through hole;

a lock tower projecting backward from the rear surface of the housing, penetrating through the one-piece rubber plug and formed with a locking portion on a projecting end part;

a rear holder arranged to cover the one-piece rubber plug from behind;

a receiving portion formed in the rear holder and configured to lock the rear holder in a state assembled with the housing by being locked to the locking portion;

a seal formed on an outer periphery of the one-piece rubber plug and being liquid-tightly held in close contact with an inner periphery of a mating connector; and the rear holder being cantilevered forward and including a peripheral wall surrounding an outer peripheral surface of the housing and an outer peripheral surface of the one-peace rubber plug.

2. The connector of claim 1, comprising a communication hole formed in the one-piece rubber plug, the lock tower liquid-tightly penetrating through the communication hole.

3. The connector of claim 2, wherein the receiving portion interferes with a tip part of the locking portion and is resiliently deflected to retract in the process of assembling the rear holder with the housing.

4. The connector of claim 3, comprising a positioning hole formed in the rear holder, the seal tower being fit into the positioning hole.

5. The connector of claim 1, comprising a positioning hole formed in the rear holder, the seal tower being fit into the positioning hole.

* * * * *